US007322575B2

(12) United States Patent
Sauer et al.

(10) Patent No.: US 7,322,575 B2
(45) Date of Patent: Jan. 29, 2008

(54) DEVICE AND METHOD FOR ALIGNING A STACK OF SHEETS ARRANGED ONE ABOVE THE OTHER

(75) Inventors: Hartmut Karl Sauer, Himmelstadt (DE); Rudolf Wukovich, Birkenfeld (DE)

(73) Assignee: KBA-Giori S.A., Lausanne (CH)

( * ) Notice: Subject to any disclaimer, the term of this patent is extended or adjusted under 35 U.S.C. 154(b) by 337 days.

(21) Appl. No.: 10/486,429

(22) PCT Filed: Jul. 19, 2002

(86) PCT No.: PCT/DE02/02661

§ 371 (c)(1),
(2), (4) Date: Jul. 26, 2004

(87) PCT Pub. No.: WO03/016188

PCT Pub. Date: Feb. 27, 2003

(65) Prior Publication Data

US 2005/0001373 A1 Jan. 6, 2005

(30) Foreign Application Priority Data

Aug. 9, 2001 (DE) ..... 101 39 218

(51) Int. Cl.
*B65H 9/00* (2006.01)

(52) U.S. Cl. ..... 271/234; 271/236; 271/186; 271/216; 271/307

(58) Field of Classification Search ..... 271/234, 271/236, 237, 248, 184, 185, 186, 197, 202, 271/216, 196, 194, 307; 414/793, 794.5, 414/794.6, 793.1

See application file for complete search history.

(56) References Cited

U.S. PATENT DOCUMENTS 2,097,013 A 10/1937 Bartholdt
3,436,073 A * 4/1969 Christmas ..... 271/186
4,060,237 A * 11/1977 Degen et al. ..... 271/231

(Continued)

FOREIGN PATENT DOCUMENTS

DE 12 32 986 1/1967

(Continued)

*Primary Examiner*—Kaitlin S. Joerger
(74) *Attorney, Agent, or Firm*—Crompton, Seager & Tufte, LLC

(57) ABSTRACT

The invention relates to a device and a method for aligning at least the front edge of several sheets arranged in a stack, one above the other, whilst maintaining the order of the sheets. Said device comprises a stacking table, one side of which is provided with a front edge stop for aligning the front edge of the sheets. A supporting platform, upon which a stack of sheets can be placed with non-aligned front edges, is arranged upstream of the stacking table. The device is provided with a sheet feeder, which removes the sheets from the supporting platform by placing them in an overlapping stream with the front edges placed under the preceding sheets. A turning device is provided downstream of the sheet feeder, said device turning the overlapping stream in such a way that the front edge area of each sheet is freely accessible. Downstream of the turning device, the invention is provided with a conveyer device, by means of which the sheets are conveyed, forming a new stack, to the front edge stop of the stacking table, where their front edges can be aligned.

19 Claims, 4 Drawing Sheets

U.S. PATENT DOCUMENTS

| | | | | | |
|---|---|---|---|---|---|
| 4,133,523 | A | * | 1/1979 | Berthelot | 271/182 |
| 4,139,190 | A | * | 2/1979 | Keyt et al. | 271/183 |
| 4,157,177 | A | * | 6/1979 | Strecker | 271/197 |
| 4,184,673 | A | * | 1/1980 | Weisbach | 271/237 |
| 4,277,060 | A | * | 7/1981 | Perobelli et al. | 271/186 |
| 4,360,196 | A | * | 11/1982 | Weisbach | 271/235 |
| 4,380,332 | A | | 4/1983 | Davis | |

FOREIGN PATENT DOCUMENTS

| | | | |
|---|---|---|---|
| DE | 68 09 156 | | 9/1970 |
| DE | 40 13 302 | A1 | 10/1991 |
| DE | 40 20 730 | A1 | 1/1992 |
| DE | 42 31 891 | A1 | 3/1994 |
| EP | 0 173 959 | A1 | 3/1986 |
| EP | 0 403 886 | A1 | 12/1990 |
| EP | 0 614 840 | A1 | 9/1994 |
| JP | 51-005111 | | 1/1976 |
| JP | 58-104850 | A | 6/1983 |
| JP | 61-075752 | A | 4/1986 |
| JP | 04-350057 | A | 12/1992 |
| JP | 2001-287851 | | 10/2001 |

* cited by examiner

DEVICE AND METHOD FOR ALIGNING A STACK OF SHEETS ARRANGED ONE ABOVE THE OTHER

TECHNICAL FIELD

Apparatus for aligning sheets arranged one above the other in a group.

The invention relates to an apparatus and a process for aligning sheets arranged one above the other in a group in accordance with the preamble of claims 1, 8 or 10.

BACKGROUND OF THE INVENTION

Apparatuses are used for example, but in no way exclusively, for aligning printed sheets along at least one edge, with sufficient accuracy, one above the other, with the result that the stack can then be trimmed at the edges. In the case of a fair number of printed products, for example notes of value provided with registration numbers, it is necessary, once the sheets have been printed, to maintain the sequence of the sheets in the stack-forming group.

DE 68 09 156 U describes an arrangement for producing an ordered stack of flat items of mail. In this case, irregularly arriving items of mail are imbricated and set down on a stack.

German patent 12 32 986 discloses a stacking apparatus for groups of folded sheets. In this case, the imbricated groups of sheets are guided around a cylinder, and turned, by means of a belt-transporting system. The groups of sheets are then aligned against stops and stacked.

EP 0 173 959 A1 discloses a sheet-processing machine to which sheets are sent from an underside of a first stack. Following processing, the non-imbricated sheets are transported to a set-down location by means of a belt system and, by means of a suction conveyor, are set down on the top of a second stack.

EP 06 14 840 A1 discloses an apparatus which is designed in the manner of a vibrating table. A supporting table is provided for this vibrating table, lateral stops being arranged on at least two, adjacent sides of the supporting table and it being possible for these stops to come into abutment against the side edges of the sheets. In order to align the group of sheets arranged one above the other, the group is set down on the supporting table and the latter is then inclined in the direction of the two stops to the extent where the side edges of the sheets come into abutment against the stops on account of gravitational force. The vibrating table is then made to vibrate in order thus to loosen the group of sheets and to allow an aligning movement of the individual sheets relative to one another.

SUMMARY OF THE INVENTION

JP 51-005111 discloses a device for transporting sheets, wherein behind the sheet feeder a turning device is arranged, with which a stream of sheets with underlap imbrication is turned in such a way that each sheet is freely accessible in the region of its leading edge.

The object of the invention is to provide an apparatus and a process for aligning sheets arranged one above the other in a group.

This object is achieved according to the invention by the features of claims 1, 8 or 10.

The advantages which can be achieved by the invention consist, in particular, in that the group of sheets with non-aligned leading edges, rather than being set down directly on the supporting table, is set down on an upstream carrying plate. The apparatus here contains a sheet feeder, by means of which the sheets set down on the carrying plate are removed individually and conveyed further, with an imbricated stream with underlap imbrication being formed in the process. In this imbricated stream with underlap imbrication, the leading edge of each sheet is located in each case beneath the immediately preceding sheet. As a result, the sequence of the sheets thus remains unchanged when the sheets are separated. Downstream of the sheet feeder, the apparatus contains a turning arrangement, by means of which the imbricated stream is turned. Turning the imbricated stream results in each sheet being fully accessible in the region of its leading edge. For actually aligning the individual sheets, a conveying arrangement is then provided downstream of the turning arrangement, this conveying arrangement conveying the sheets individually to the leading-edge stop of the supporting table. By virtue of the leading edges of the sheets butting against the leading-edge stop, the desired alignment of the sheets is achieved and, at the same time, a new group of sheets, all butting against the leading-edge stop in each case, is formed. Since the sheets each rest on top of the newly formed group during the aligning movement against the leading-edge stop, the aligning movement is not obstructed by the weight of the other sheets. At the same time, however, the sequence of the sheets in the group, in contrast to a restacking operation, for example, is maintained. Once all the sheets of the original groups have passed through, a new group of sheets with aligned leading edges has then formed on the supporting table, the originally uppermost sheet being located right at the bottom in the new group.

An exemplary embodiment of the invention is described in more detail hereinbelow and illustrated in the drawings, in which:

DETAILED DESCRIPTION OF THE PREFERRED EMBODIMENTS

Figure 1:
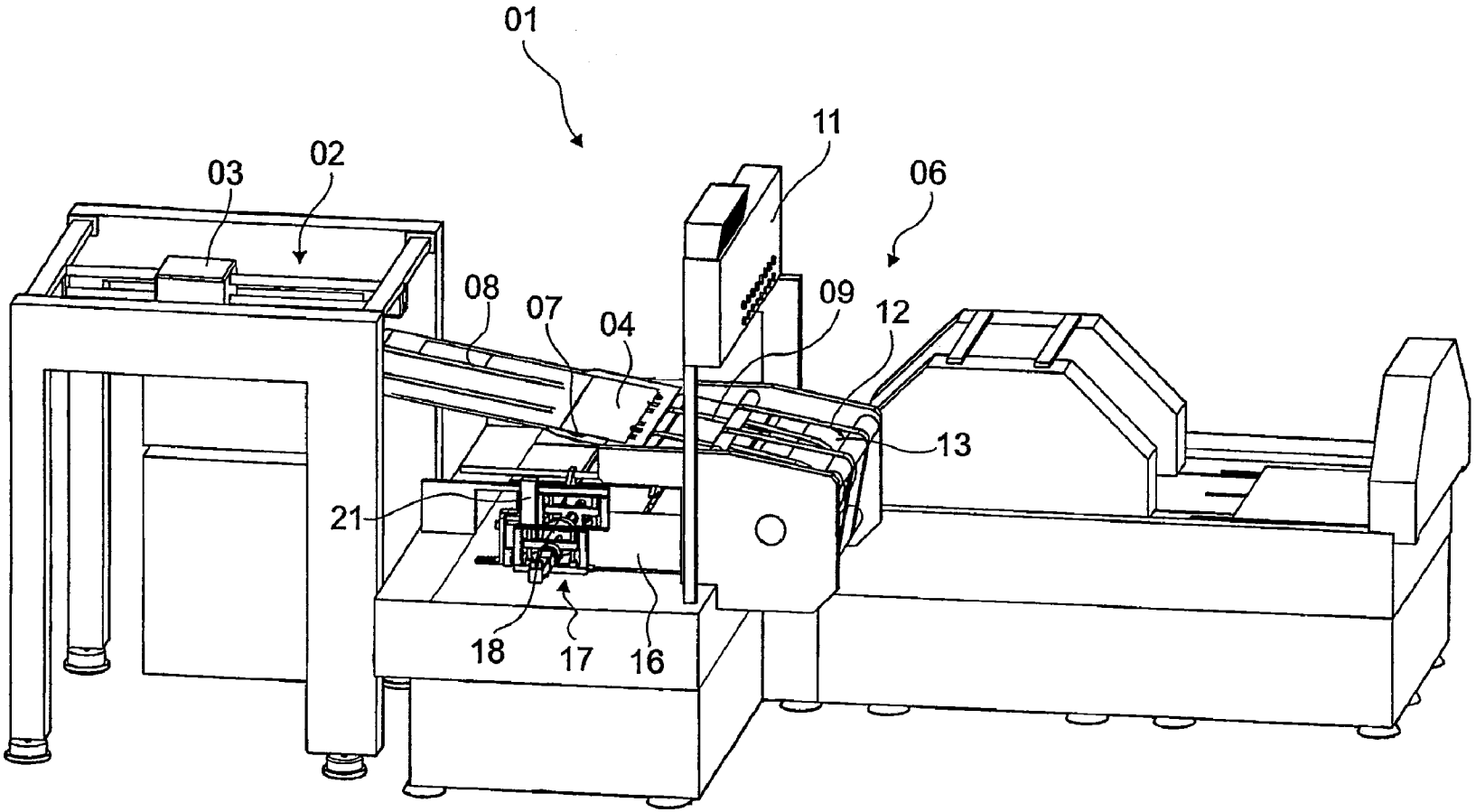
FIG. 1 shows a perspective view from above of an apparatus for aligning sheets.

In order to form an apparatus 01, use may be made of a known sheet feeder 02. The sheet feeder 02 contains a carrying plate, which is concealed from view in FIG. 1 and on which a group of sheets 04 arranged one above the other, for example sheets printed with securities and registration numbers, can be set down. Using a displaceable suction roller 03, the sheets 04 are removed individually, in a known manner, from the group and, forming an imbricated stream with underlap imbrication, in the case of which the sheets 04 have their leading edge located beneath the preceding sheet 04 in each case, are conveyed further in the direction of a turning arrangement 06.

Provided between the sheet feeder 02 and turning arrangement 06 is a side pull-type lay 07, against which the right-hand side edge of the individual sheets 04 of the imbricated stream are aligned laterally.

The conveying speed of the suction belts 08 in the sheet feeder 02 here is higher than the conveying speed of the suction belts 09 in the turning arrangement 06, with the result that the conveying speed of the imbricated stream is reduced following alignment of the sheets 04 against the side pull-type lay 07. Consequently, the overlapping between individual sheets 04 in the imbricated stream is increased and the imbricated stream is thus conveyed further more slowly, with the result that the already laterally aligned sheets 04 run more smoothly. At an operating console 11, it is possible for control commands for the apparatus 01 to be entered and for various operating states to be indicated.

Figure 2:
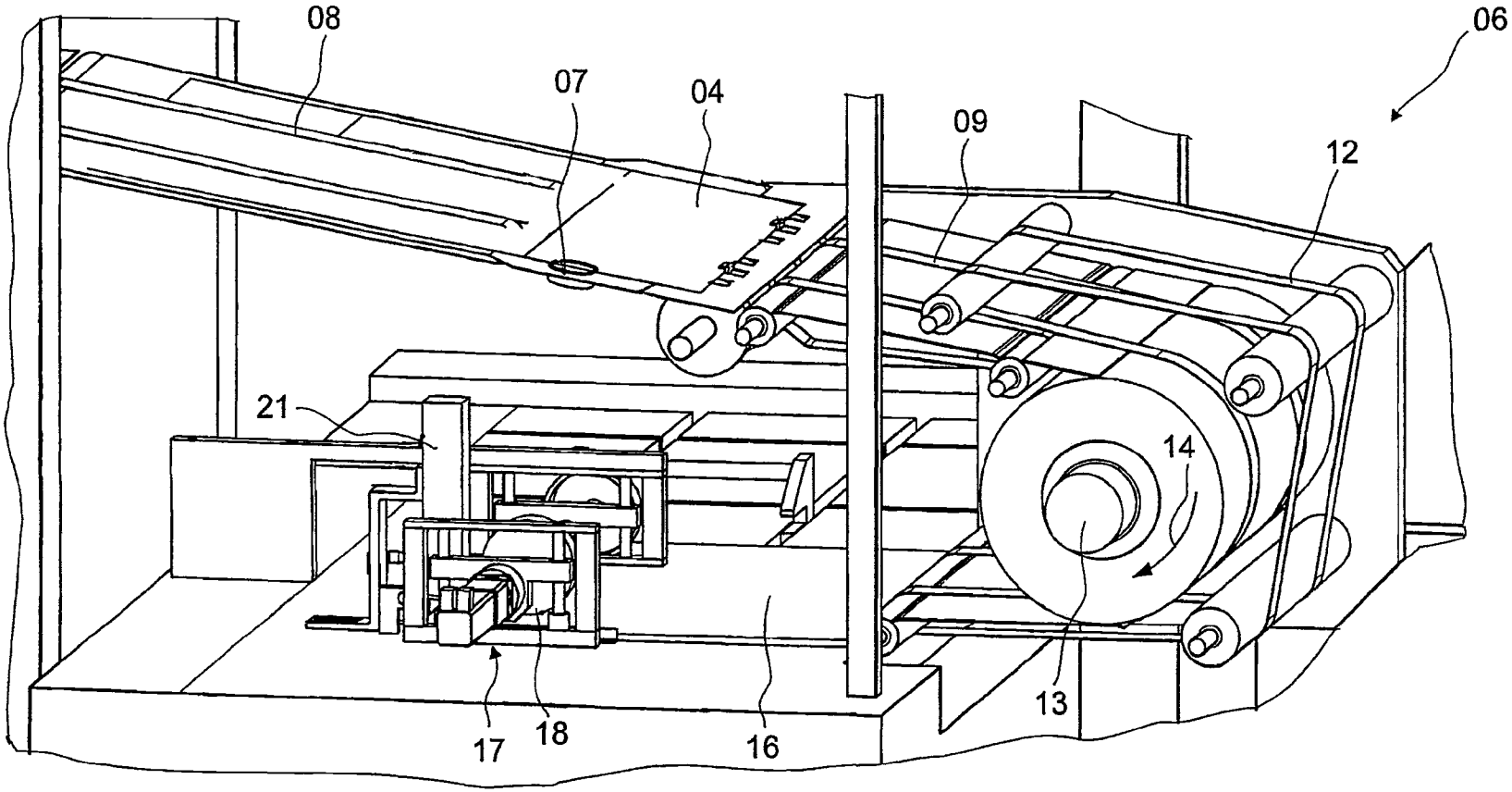
FIG. 2 shows a perspective view from above of an enlarged detail of the apparatus according to FIG. 1.

At the inlet of the turning arrangement 06, as is illustrated in FIG. 2, the sheets 04 are drawn in between the suction belts 09 and circulating guide belts 12 and turned 150°-210° and conveyed further in the direction of a roller 13, e.g. a suction roller 13. The suction roller 13 rotates in the direction of the movement arrow 14, with the result that the sheets 04 of the imbricated stream, which has underlap imbrication at the inlet, are turned such that the sheets 04 at the outlet of the turning arrangement 06 are freely accessible in each case in the region of their leading edges, whereas the trailing edge of each sheet 04 is located beneath the respectively following sheet 04 in the imbricated stream.

Figure 4:
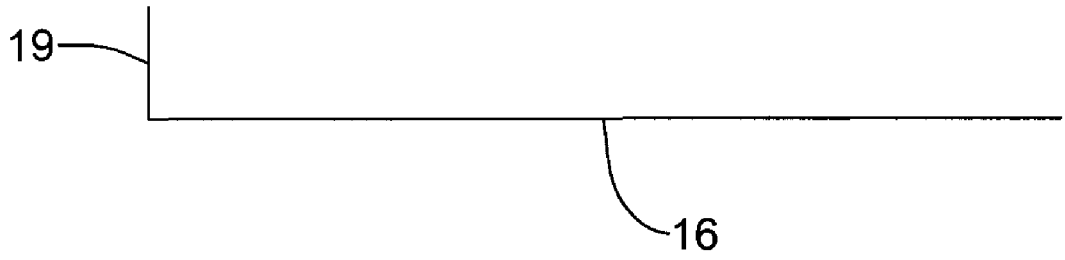
FIG. 4 diagrammatic shows a portion of the apparatus according to FIG. 1.

Arranged downstream of the outlet of the turning arrangement 06 is a supporting table 16, at the rear end of which is provided a leading-edge stop, which is concealed from view in FIG. 2. FIG. 4 diagrammatically shows leading-edge stop 19 disposed at the rear end of the supporting table 16. By means of a suction-body unit 17 which serves as a conveying arrangement 17 and has two suction bodies 18 which can be driven in rotation, e.g. a suction roller 18, the individual sheets 04 of the imbricated stream can be successively attached by suction in the region of their leading edges and conveyed against the leading-edge stop, which is concealed from view. Continued operation of the apparatus 01 results in a new group of sheets 04 arranged one above the other, and with their leading edges and side edges aligned in each case, forming on the supporting table 16. In order that the weight to which the sheets 04 of the new group is subjected by the suction-body unit 17 does not obstruct the alignment of the leading edges, it is possible for the height of the new group to be measured by a sensor (not illustrated) and for the suction-body unit 17 to be adjusted vertically in dependence on this measured value. As a result, the suction rollers 18 thus always have their circumference level with the top side of the new group and thus do not press on the uppermost sheet 04 which is to be aligned in each case.

The apparatus 01 may be operated, for example, as follows:

Once, for example, one hundred sheets 04 have been drawn off by way of the apparatus 01, the apparatus 01 is switched off for a certain period of time, with the result that the sheet travel is interrupted. The sheets 04, which are respectively collected in an imbricated stream, are then conveyed by the turning arrangement 06 to the supporting table 16 and stacked there, with a new group being formed in the process. As soon as all the sheets 04 of the imbricated stream have been aligned against the front lay, the respective group is conveyed further by way of the supporting table 16 in the direction of a downstream apparatus (not illustrated) which serves, for example, for trimming the edges of the sheets 04.

Throughout the procedure, the leading end of the sheet removed from the first stack is oriented in the transporting direction, i.e. the leading ends of the sheets is also leading, in relation to the transporting direction, in the case of the set-down stack.

For banknote printing, the apparatus 01 may contain a camera system 21 which can observe the registration numbers of the individual sheets 04.

Figure 3:
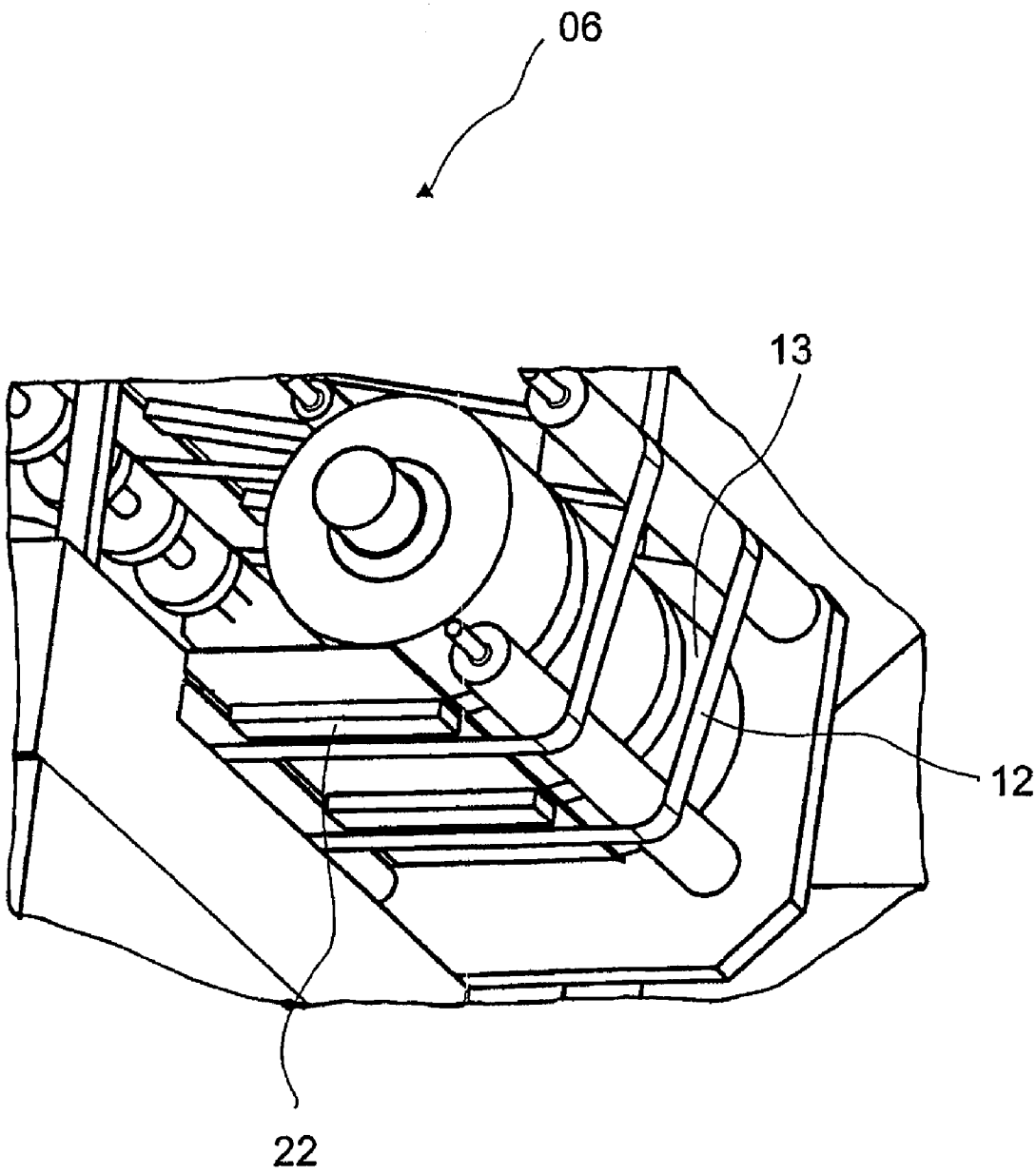
FIG. 3 shows a perspective view from beneath of a turning arrangement for use in an apparatus according to FIG. 1.

FIG. 3 illustrates a perspective view from beneath of the turning arrangement 06 with the circulating guide belts 12 and the suction roller 13. It can be seen that the guide belts 12, at the outlet of the turning arrangement 06, are guided along suction boxes 22 and thus function, at the outlet of the turning arrangement 06, in the manner of suction belts 12. This ensures that the sheets 04 are attached by suction at the outlet of the turning arrangement 06, and are secured in position in this way.

List of designations

| | |
|---|---|
| 01 | Apparatus |
| 02 | Sheet feeder |
| 03 | Suction roller |
| 04 | Sheet |
| 05 | — |
| 06 | Turning arrangement |
| 07 | Side pull-type lay |
| 08 | Suction belts (02) |
| 09 | Suction belts (06) |
| 10 | — |
| 11 | Operating console |
| 12 | Guide belt, suction belt |
| 13 | Roller, suction roller |
| 14 | Movement arrow |
| 15 | — |
| 16 | Supporting table |
| 17 | Conveying arrangement, suction-body unit |
| 18 | Suction body, suction roller |
| 19 | — |
| 20 | — |
| 21 | Camera system |
| 22 | Suction box |

The invention claimed is:

1. An apparatus for aligning at least the leading edges of a plurality of sheets arranged one above the other in a group, while maintaining the sequence of the sheets, having:

a supporting table with a leading-edge stop for aligning the leading edges of the sheets;

a carrying plate arranged upstream of the supporting table, on which carrying plate the sheets are set down in a group with non-aligned leading edges;

a sheet feeder, by means of which the sheets are removed from the carrying plate to form an imbricated stream with underlap imbrication;

a turning arrangement arranged downstream of the sheet feeder, by means of which turning arrangement the imbricated stream is turned such that each sheet is freely accessible in the region of its leading edge; and a conveying arrangement arranged downstream of the turning arrangement, by means of which conveying arrangement the sheets are conveyed to the leading-edge stop of the supporting table, a new group of sheets with aligned leading edges, the apparatus further comprising a side pull-type lay arranged between the sheet feeder and turning arrangement, against which side pull-type lay a side edge of each sheet in the imbricated stream is aligned laterally, wherein the conveying arrangement is designed in the manner of a suction-body unit which is arranged above the supporting table such that sheets are conveyed between the suction-body unit and the group of sheets formed on the supporting table, said suction-body unit being mounted in a vertically displaceable manner and comprising suction rollers which are driven in rotation, said suction rollers cooperating with the sheets of the imbricated stream by suction in the region of the freely accessible leading edges of the sheets in order to convey each sheet against the leading-edge stop.

2. An apparatus for aligning at least the leading edges of a plurality of sheets arranged one above the other in a group, while maintaining the sequence of the sheets, having:

a supporting table with a leading-edge stop for aligning the leading edges of the sheets;

a carrying plate arranged upstream of the supporting table, on which carrying plate the sheets are set down in a group with non-aligned leading edges;

a sheet feeder, by means of which the sheets are removed from the carrying plate to form an imbricated stream with underlap imbrication;

a turning arrangement arranged downstream of the sheet feeder, by means of which turning arrangement the imbricated stream is turned such that each sheet is freely accessible in the region of its leading edge; and a conveying arrangement arranged downstream of the turning arrangement, by means of which conveying arrangement the sheets are conveyed to the leading-edge stop of the supporting table, a new group of sheets with aligned leading edges, the apparatus further comprising a side pull-type lay arranged between the sheet feeder and turning arrangement, against which side pull-type lay a side edge of each sheet in the imbricated stream is aligned laterally, a conveying speed of the sheets following alignment of the side edges thereof against the side pull-type lay is being reduced in order to increase the overlapping of the sheets in the imbricated stream, wherein the conveying arrangement is designed in the manner of a suction-body unit which is arranged above the supporting table such that sheets are conveyed between the suction-body unit and the group of sheets formed on the supporting table, said suction-body unit being mounted in a vertically displaceable manner and comprising suction rollers which are driven in rotation, said suction rollers cooperating with the sheets of the imbricated stream by suction in the region of the freely accessible leading edges of the sheets in order to convey each sheet against the leading-edge stop.

3. The apparatus as claimed in claim 1, wherein the turning arrangement comprises a roller, against the circumference of which the sheets of the imbricated stream are brought into abutment and turned by virtue of the roller being driven in rotation.

4. The apparatus as claimed in claim 3, wherein the turning arrangement comprises guide belts, by means of which the sheets can be pressed, at least in certain sections, onto the circumference of the roller.

5. The apparatus as claimed in claim 4, wherein the guide belts are designed, at least at the outlet of the turning arrangement, as suction belts.

6. An apparatus for transporting sheets by means of at least one conveying arrangement having a suction body unit, said suction body unit being arranged above a sheet stack comprising a plurality of sheets, imbricated sheets being fed to the sheet stack between the suction body unit and sheet stack, the suction-body unit being mounted in a vertically displaceable manner, wherein the suction body unit compromises suction rollers which are driven in rotation.

7. The apparatus as claimed in claim 1, wherein the conveying speed of the conveying arrangement can be changed, in particular regulated or controlled.

8. The apparatus as claimed in claim 1, wherein the suction-body unit is mounted resiliently.

9. The apparatus as claimed in claim 1, wherein a vertical position of the suction-body unit can be changed in dependence on the height of the newly formed group of sheets.

10. The apparatus as claimed in claim 2, wherein the turning arrangement comprises a roller, against the circumference of which the sheets of the imbricated stream are brought into abutment and turned by virtue of the roller being driven in rotation.

11. The apparatus as claimed in claim 2, wherein the conveying speed of the conveying arrangement can be changed, in particular regulated or controlled.

12. The apparatus as claimed in claim 6, wherein the conveying speed of the conveying arrangement can be changed, in particular regulated or controlled.

13. The apparatus as claimed in claim 2, wherein the suction-body unit is mounted resiliently.

14. The apparatus as claimed in claim 2, wherein a vertical position of the suction-body unit can be changed in dependence on the height of the newly formed group of sheets.

15. The apparatus as claimed in claim 6, wherein a vertical position of the suction-body unit can be changed in dependence on the height of the sheet stack.

16. The apparatus as claimed in claim 6, wherein the suction-body unit is mounted resiliently.

17. The apparatus as claimed in claim 6, wherein the sheets are fed to the sheet stack in the form of an imbricated stream of sheets such that each sheet is freely accessible in region of its leading edge for cooperation with the suction rollers.

18. The apparatus as claimed in claim 6, further comprising a turning arrangement placed upstream of the suction-body unit for turning an imbricated stream of sheets with underlap imbrication such that each sheet is freely accessible in the region of its leading edge for cooperation with the suction rollers.

19. The apparatus as claimed in claim 6, further comprising a leading-edge stop for alignment of the leading edge of each sheet fed to the sheet stack.

* * * * *